US007664378B2

(12) United States Patent
Gao

(10) Patent No.: US 7,664,378 B2
(45) Date of Patent: Feb. 16, 2010

(54) FAN HEATER

(76) Inventor: Tianyu Gao, Jinke Bldg., 8 Qiongyu Rd, Science & Technology Park, Nanshan Dist. Shenzhen (CN)

( * ) Notice: Subject to any disclaimer, the term of this patent is extended or adjusted under 35 U.S.C. 154(b) by 472 days.

(21) Appl. No.: 11/634,414

(22) Filed: Dec. 5, 2006

(65) Prior Publication Data

US 2007/0297773 A1 Dec. 27, 2007

(30) Foreign Application Priority Data

Jun. 22, 2006 (CN) ..... 2006 1 0061273

(51) Int. Cl.
*F24H 3/02* (2006.01)

(52) U.S. Cl. ..... 392/360; 392/347

(58) Field of Classification Search ..... None
See application file for complete search history.

(56) References Cited

U.S. PATENT DOCUMENTS

| | | | | | |
|---|---|---|---|---|---|
| 2,131,484 | A * | 9/1938 | Ringwald | 392/376 |
| 3,175,550 | A * | 3/1965 | Knapp | 392/376 |
| 3,229,070 | A * | 1/1966 | Wells | 392/367 |
| 3,664,349 | A * | 5/1972 | Quick | 460/99 |
| 5,761,377 | A * | 6/1998 | Wolfe et al. | 392/376 |
| D397,192 | S * | 8/1998 | Chiu et al. | D23/328 |
| 5,909,534 | A * | 6/1999 | Ko | 392/376 |
| 6,321,034 | B2 * | 11/2001 | Jones-Lawlor et al. | 392/367 |
| 6,351,602 | B1 * | 2/2002 | Chaney et al. | 392/376 |
| D479,589 | S * | 9/2003 | Koike | D23/336 |
| D483,457 | S * | 12/2003 | Wang | D23/336 |
| D483,851 | S * | 12/2003 | Fok | D23/378 |
| 6,760,543 | B1 * | 7/2004 | Orr et al. | 392/365 |
| 6,973,260 | B2 * | 12/2005 | Orr et al. | 392/365 |
| 7,088,913 | B1 * | 8/2006 | Verhoorn et al. | 392/367 |
| D533,649 | S * | 12/2006 | Maitland et al. | D23/340 |
| 7,156,616 | B2 * | 1/2007 | Lee | 415/127 |
| 7,158,716 | B2 * | 1/2007 | Shapiro et al. | 392/365 |
| D543,612 | S * | 5/2007 | Fok | D23/336 |
| 7,357,620 | B2 * | 4/2008 | Russak et al. | 415/213.1 |
| D571,445 | S * | 6/2008 | Vandenbelt | D23/364 |
| D586,450 | S * | 2/2009 | Lewis | D23/341 |
| 2001/0031137 | A1 * | 10/2001 | Jones-Lawlor et al. | 392/367 |
| 2002/0192075 | A1 * | 12/2002 | Block | 415/176 |
| 2003/0026600 | A1 * | 2/2003 | Delonghi | 392/365 |
| 2004/0197091 | A1 * | 10/2004 | Orr et al. | 392/365 |

* cited by examiner

*Primary Examiner*—Thor S Campbell
(74) *Attorney, Agent, or Firm*—Raymond Y. Chan; David & Raymond Patent Firm

(57) ABSTRACT

A fan heater includes a heater body, an electric unit, a plurality of fan assemblies, and a heating element. Each of the fan assemblies is mounted with the adjacent fan assembly to form a fan unit within the receiving cavity, wherein the fan unit is operatively coupled with the electric unit for being driven to rotate by the electric unit. The heating element is mounted within the receiving cavity in a vicinity of the air outlet, and electrically connected with the electric unit for being heated up at an elevated temperature, wherein the fan assemblies are adapted to draw air flowing from an air inlet to an air outlet via the heating element, so as to heat up the air drawn by the fan unit, and deliver the heated air to a predetermined heating zone from the air outlet.

15 Claims, 6 Drawing Sheets

FAN HEATER

BACKGROUND OF THE PRESENT INVENTION

1. Field of Invention

The present invention relates to a fan, and more particularly to a fan heater which comprises a plurality of blade assemblies for minimizing the weight and the manufacturing cost of the fan heater.

2. Description of Related Arts

A conventional fan heater is usually a compact electrical household appliance, which heats the room by drawing air to go through a plurality of electrical heating elements, such as heating wires, provided within the fan heater.

A typical fan heater usually comprises a heater body, a fan, a heating element, and a power unit electrically connecting the heating element and the fan with a power source. The heater body usually has an air inlet, an air outlet, and a receiving cavity formed within the heater body to communicate between the air inlet and the air outlet, wherein the heating element is mounted in the vicinity of the air outlet. The fan is rotatably mounted with in the receiving cavity in such a manner that when it is activated, it will rotate to draw air from the air inlet, and force air out from the air outlet via the heating element. Thus, at the same time the fan is being driven to rotate, the heating element is electrically conducted to generate heat, so that the air which is forced to blow out from the air outlet is first pushed to thermally communicate with the heating element before it is blown out from the air outlet. The result is that the air coming out from the air outlet is heated to a predetermined temperature according to the elevated temperature of the heating element.

The fans used in convention fan heaters can broadly be divided into three major types according to the mechanical structure of the fans used and the position of the air inlets and the air outlets. First, there exists radial flow fan which is capable of delivering air flow in radial direction with respect to the fan. Second, there exists axial flow fan which is capable of drawing air flow along an axial direction of the fan. Finally, there exists centrifugal fan in which the inflow air is ninety degrees with respect to the outflow air. Accordingly, the air inlet and the air outlet are formed at the corresponding positions on the heater body.

A main problem for these conventional fan heaters is that the fan, no matter which kind is it, is usually made of metallic materials which, although strong and durable, are very heavy. As a result, conventional fan heaters are usually bulky in size, and heavy in weight. This makes conventional fan heaters extremely difficult to carry and transport. Moreover, since the heater fan blades are made of metallic materials, when the fan is rotating within the heater body, the heavy heater fan blades will induce substantial vibration to the entire heater body as well as other components of the fan heater. The result is to make the fan heater very noisy when it is operating.

Furthermore, most of the fans mounted within the receiving cavity are manufactured as separate integral pieces which increase the difficulty for securely mounting onto the respective heater body in rotatably movable manner. Thus, conventional process for manufacturing fan heaters involves expensive manufacturing machines and complicated steps. These in turn have contributed to the elevated selling price of conventional fan heaters, and prohibited a widespread application of fan heaters.

SUMMARY OF THE PRESENT INVENTION

A main object of the present invention is to provide a fan heater which comprises a plurality of blade assemblies for minimizing the weight, the complicity of assembling, and the manufacturing cost of the present invention.

Another object of the present invention is to provide a fan heater which comprises a plurality of blade assemblies, wherein each of the blade assemblies is attached to an adjacent blade assembly to form a fan unit of the fan heater.

Another object of the present invention is to provide a fan heater comprising a plurality of fan assemblies each of which is made of light-weight materials, such as plastics materials, so as to minimize the weight of the present invention.

Another object of the present invention is to provide a fan heater which does not produce a substantial amount of noise when operating so as to prevent the corresponding shortcoming as present in the conventional fan heaters.

Accordingly, in order to accomplish the above objects, the present invention provides a fan arrangement for a fan heater which comprises a heater body having an air inlet, and air outlet, and a receiving cavity to communicate between the air inlet and the air outlet, an electric unit having a driving shaft disposed in the heater body within the receiving cavity for electrically connecting to a power source, and a heating element, wherein the fan arrangement comprises:

a plurality of fan assemblies each of which is mounted with the adjacent fan assembly to form an integral fan unit within the receiving cavity, wherein the fan unit is operatively coupled with the electric unit for being driven to rotate by the electric unit, wherein when the electric unit is activated to drive the fan unit to rotate and heat up the heat element at the elevated temperature, the fan assemblies are adapted to draw air flowing from the air inlet to the air outlet via the heating element, so as to heat up the air drawn by the fan unit, and deliver the heated air to a predetermined heating zone from the air outlet.

These and other objectives, features, and advantages of the present invention will become apparent from the following detailed description, the accompanying drawings, and the appended claims.

DETAILED DESCRIPTION OF THE PREFERRED EMBODIMENT

Figure 1:
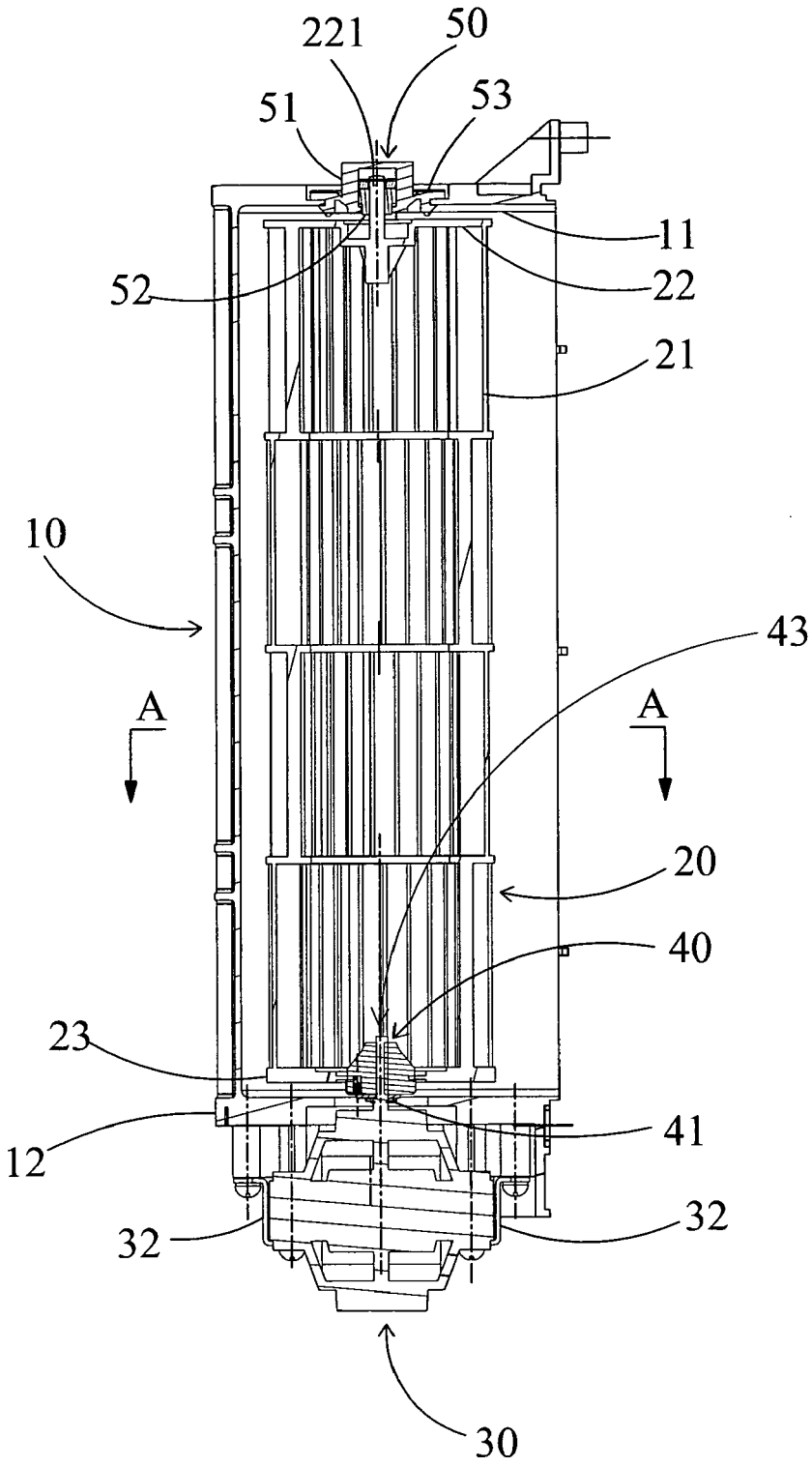
FIG. 1 is a side view of a fan heater according to a preferred embodiment of the present invention.
Figure 2:
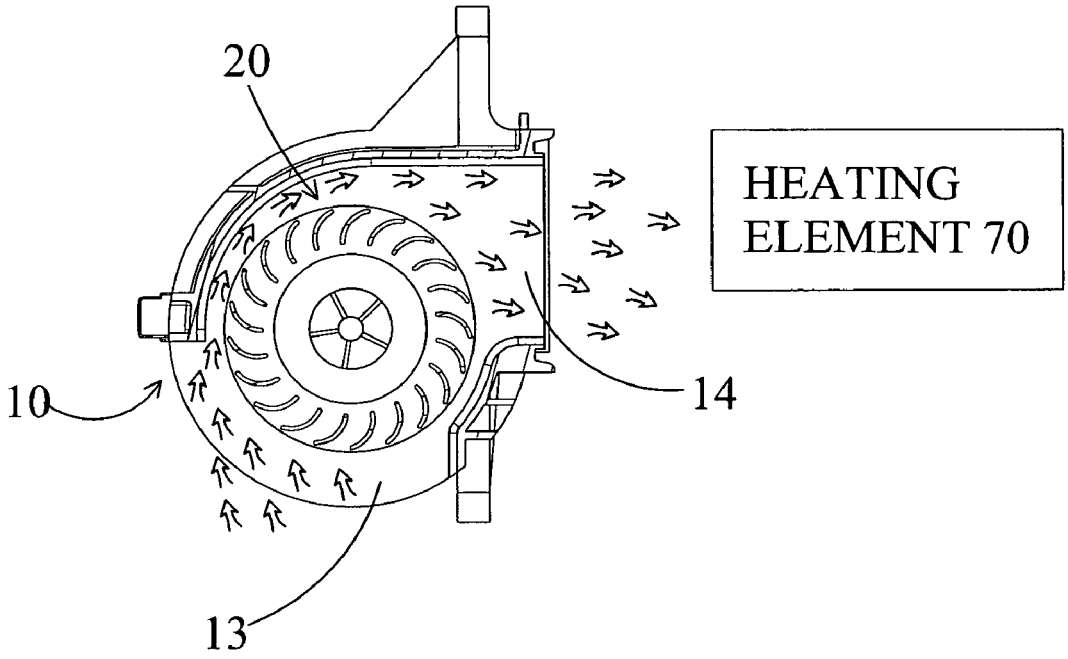
FIG. 2 is a schematic view of the fan assembly according to the above preferred embodiment of the present invention.
Figure 3:
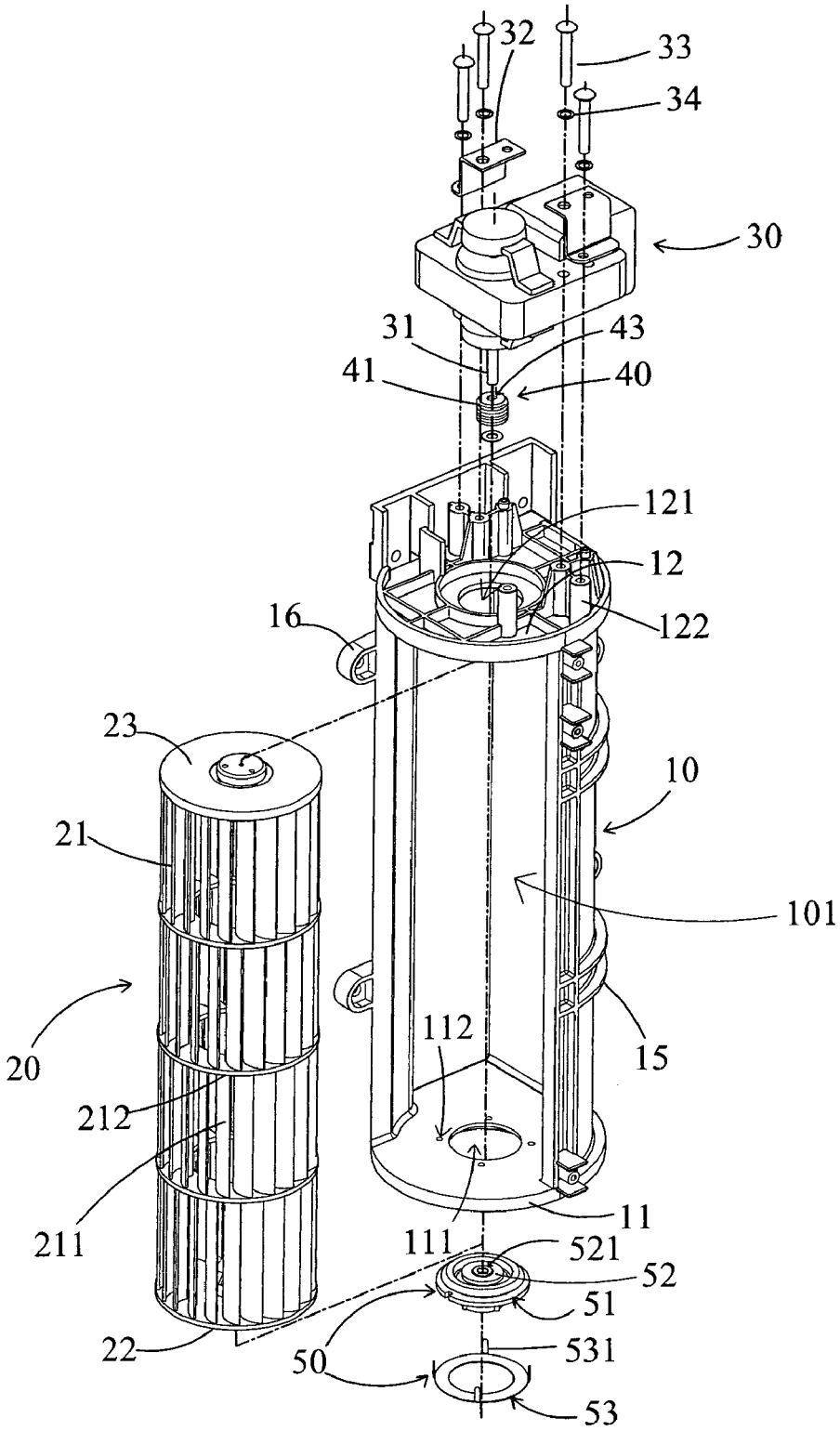
FIG. 3 is an exploded perspective view of the fan heater according to the above preferred embodiment of the present invention.

Referring to FIG. 1 to FIG. 5 of the drawings, a fan heater according to a preferred embodiment of the present invention is illustrated, in which the fan heater comprises a heater body 60, an electric unit 30, a fan arrangement 20 comprising a plurality of fan assemblies 21, and a heating element 70.

The heater body 60 has an air inlet 13, an air outlet 14, and a receiving cavity 17 to communicate between the air inlet 13 and the air outlet 14.

The electric unit 30 is supported in the heater body 60 within the receiving cavity 17 for electrically connecting to a power source, such as an external AC power source.

Each of the fan assemblies 21 is mounted with an adjacent fan assembly 21 to form a fan unit within the receiving cavity 17, wherein the fan unit is operatively coupled with the electric unit 30 for being driven to rotate by the electric unit 30.

The heating element 70 is mounted within the receiving cavity 17 in a vicinity of the air outlet 14, and electrically connected with the electric unit 30 for being heated up at an elevated temperature, wherein when the electric unit 30 is activated to drive the fan unit to rotate and heat up the heating element 70 at the elevated temperature, the fan assemblies 21 are adapted to draw air flowing from the air inlet 13 to the air outlet 14 via the heating element 70, so as to heat up the air drawn by the fan unit, and deliver the heated air to a predetermined heating zone from the air outlet 14.

According to the preferred embodiment of the present invention, the heater body 60 is elongated in shape and has a top panel 18, a bottom panel 19, and a sidewall 161 extended between the top panel 18 and the bottom panel 19, wherein the receiving cavity 17 is defined between the top panel 18, the bottom panel 19 and sidewall 161. As shown in FIG. 1 of the drawings, the fan arrangement 20 further comprises a tubular supporting casing 10, having a top ceiling 11, a bottom panel 12, and a supporting compartment 101 formed between the top ceiling 11 and the bottom panel 12, wherein the supporting casing 10 is disposed within the receiving cavity 17 for rotatably supporting the fan unit within the supporting compartment 101. Thus, the supporting compartment 101 communicates with the receiving cavity 17 via the air inlet 13 and the air outlet 14.

The electric unit 30 comprises a motor, such as a conventional high performance motor, mounted underneath the supporting casing 10, wherein the electric unit 30 further comprises a driving shaft 31 extended from the motor for delivering a rotational power to drive the fan unit to rotate. In order to securely mount the motor onto the supporting casing 10, the electric unit 30 further comprises at least one L-shaped connector 32, a plurality of screwing connectors 33, and a plurality of washers 34, wherein the motor is mounted onto a bottom portion of the supporting casing 10 through the L-shaped connector 32, the screwing connectors 33 and the washers 34. Accordingly, a bottom panel 12 of the supporting casing 10 has a through hole 121 formed thereon, wherein the electric unit 30 is mounted underneath the supporting casing 10 at the through hole 121, via a plurality of screwing posts 122 and screws.

Figure 4:
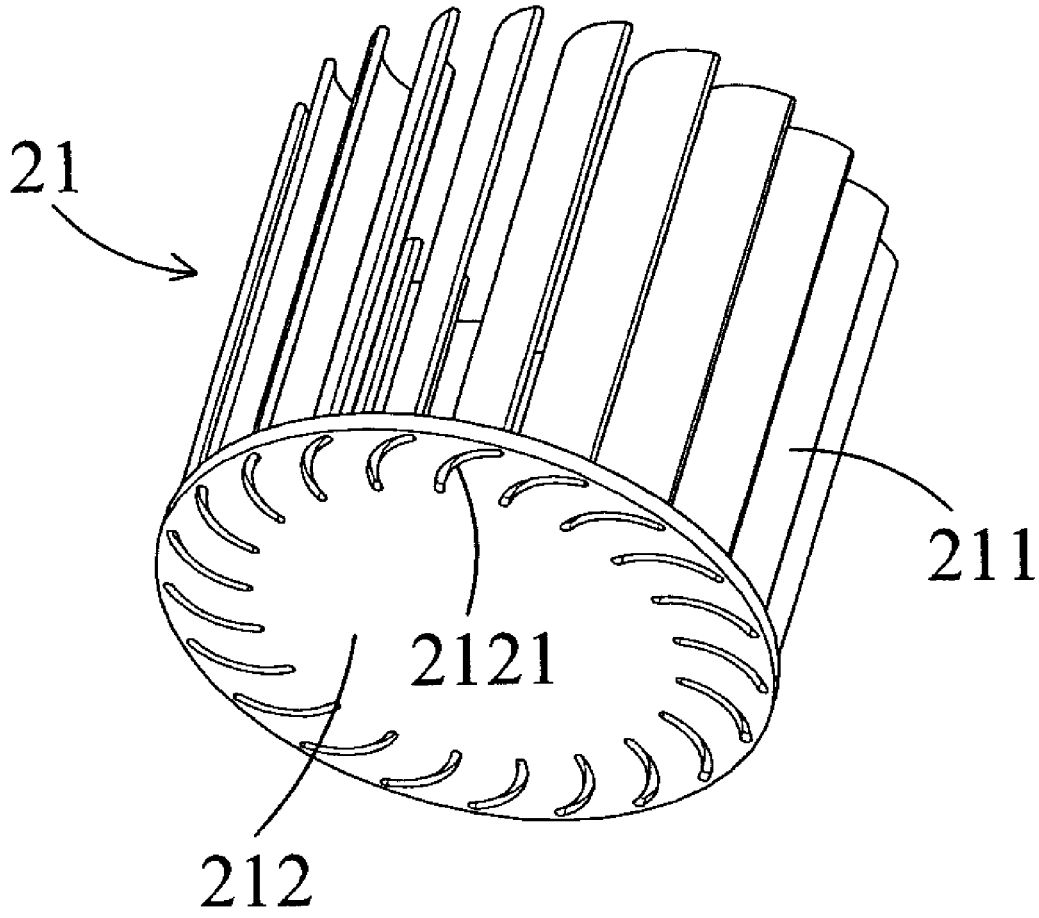
FIG. 4 is a perspective view of a fan assembly according to the above preferred embodiment of the present invention.

The fan arrangement 20 further comprises a top mounting member 22, a bottom mounting member 23, and a plurality of connecting members 212 spacedly supported between the top mounting member 22 and the bottom mounting member 23, wherein the fan assemblies 21 are spacedly and securely attached on the corresponding connecting members 212 for forming the fan unit of the fan arrangement 20. Referring to FIG. 4 of the drawings, each of the connecting members 212 has a substantially circular cross section wherein the corresponding fan assemblies 21 is securely mounted, preferably through welding, on the connecting members 212 for ultimately forming the fan unit.

More specifically, each of the fan assemblies 21 comprises a plurality of heater fan blades 211 each having a top edge portion and a bottom edge portion mounted with two corresponding connecting members 212 respectively so as to securely attach with the corresponding adjacent fan assembly 21. Accordingly, each of the connecting members 212 has a plurality of mounting slots 2121 formed on a top and a bottom sides of the connecting member 212, wherein each of the heater fan blades 211 are adapted to insert and mount into the corresponding mounting slot 2121 for securely attaching thereon. Accordingly, the cross section of each of the mounting slots 2121 is the same as that of the corresponding heater fan blade 211 so as to allow fit engagement between the heater fan blade 211 and the corresponding connecting members 212.

It is worth mentioning that the mounting slots 2121 formed on the top side of the connecting member 212 is not aligned with the mounting slots 2121 formed on the bottom side of that connecting member 212 so that each single connecting member 212 is arranged to hold the heater fan blades 211 on both sides thereof so as to minimize a thickness of the connecting member 212 and maximize a connection strength between the heater fan blades 212 and the corresponding connecting members 212. Moreover, it is important to stress at this stage that each of the heater fan blades 211 is made of light materials, such as plastics materials, so as to ensure that the weight of the entire fan heater can be kept to minimal. Since the weight of the fan heater is minimized, it is expected that when the fan heater is operating, the vibration thereof can also be minimized so as to minimize the noise generated from the fan heater of the present invention.

Each of the top mounting member 22 and the bottom mounting member 23 also has a plurality of the mounting slots 2121 indently formed on an inner surface of the respective top mounting member 22 and the bottom mounting member 23, wherein the mounting slots 2121 are aligned with the corresponding heater fan blades 211 respectively so as to mount the corresponding heater fan blades 211 with the top mounting member 22 and the bottom mounting member 23 to form an integral fan unit.

Each of the fan blades 211, having a predetermined blade contour, is spacedly mounted on the respective connecting members 212 and/or the mounting member 22, 23 at a predetermined angle in such a manner that when the fan unit is driven to rotate, each of the fan blades 211 is capable of drawing air to pass through the fan unit at a space between each two of the fan blades 211 in a predetermined flow rate and direction, so as to draw air to be heated up by the fan heater. Thus, the fan blades 211 are mechanically designed to draw the maximum amount of air to be heated up by the fan heater, wherein the contours of the fan blades 211 allow maximum efficiency to be achieved.

According to the preferred embodiment of the present invention, the fan connector 40 of the fan arrangement 20, which is made by plastic materials, is adapted to mount the electric unit 30 with the fan unit of the fan arrangement 20 so as to ensure effective power transmission between the electric unit 32 and the fan arrangement 20.

More specifically, the fan connector 40 is integrally provided on the bottom mounting member 23 for connecting with the electric unit 30, wherein the fan connector 40' has a main connector body 41, and a connecting hole 43 formed thereon for connecting with the driving shaft 31 of the electric unit 30. It is worth mentioning that a diameter of the connecting hole 43 is slightly smaller than a diameter of the driving shaft 31 so that when the driving shaft is mounted to the connecting hole 43, a lateral movement between the driving shaft and the fan unit can be minimized so as to ensure an effective power transmission between the electric unit 30 and the fan arrangement 20.

In order to allow smooth rotation of the fan unit, the fan arrangement 20 further comprises a bearing unit 50 rotatably connecting the fan unit with the supporting casing 10, wherein the bearing unit 50 comprises a bearing seat 51 supported between a top ceiling of the supporting casing 10 and the top mounting member 22 of the fan arrangement 20, a shaft bearing 52, having a through shaft supporting slot 521, integrally mounted on the bearing seat 51, and a securing member 53 mounted on the bearing seat 51 through a plurality of securing legs 531. The supporting casing 10 further has a through bearing hole 111 formed on the top ceiling 12 for the bearing seat 51 to be securely mounted at the bearing hole 111. Referring to FIG. 1 of the drawings, the top mounting member 22 of the fan arrangement 20 further has a rotating shaft 221 upwardly and integrally extended therefrom to insert into the shaft supporting slot 521 of the shaft bearing 52, in such a manner that when the fan unit is driven to rotate, the bearing unit 50 is adapted to substantially support the rotational movement of the fan unit.

Figure 5:
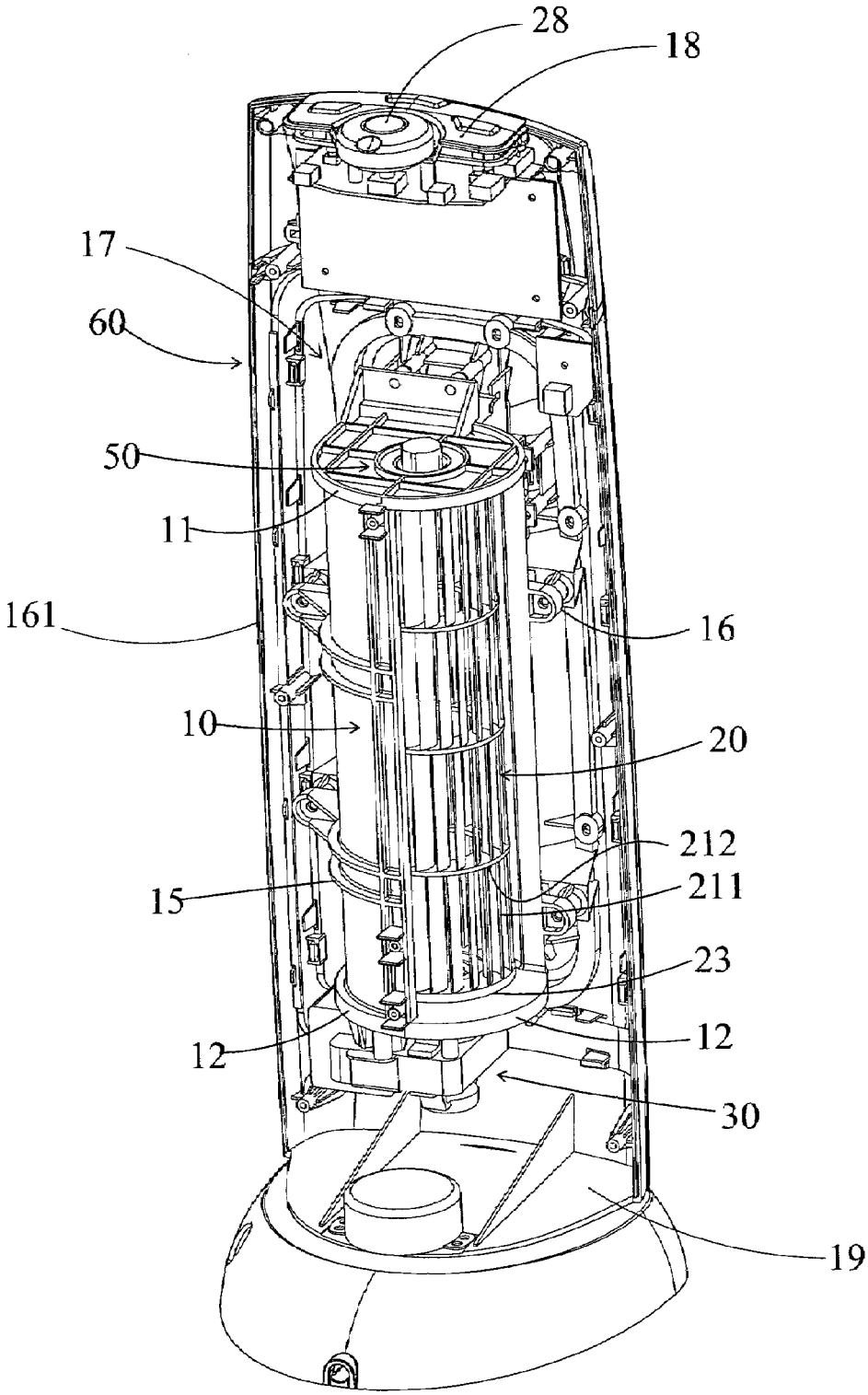
FIG. 5 is a schematic diagram of the fan heater according to the above preferred embodiment of the present invention.

In order to enhance the strength of the supporting casing 10, the supporting casing 10 further comprises a plurality of reinforcing ribs 15 spacedly protruded from an outer surface of the supporting casing 10 so as to enhance the ability to which the supporting casing 10 could resist external impact. Moreover, the supporting casing 10 is connected with the main body 60 via a plurality of connecting sleeves 16, 61, as shown in FIG. 5 of the drawings.

In order to control an operation of the fan heater of the present invention, the fan arrangement 20 further comprises a control panel 28 provided on the main body 60 to electrically connect with the electric unit 30 for allowing a user to selectively control a rotation of the fan unit.

The operation of the present invention is as follows: the electric unit 30 is electrically connected to an external power source, preferably an external AC power source. When it is activated, the driving shaft 31 will drive the fan unit to rotate within the receiving cavity 17, thereby drawing air from the air inlet 13. The air drawn by the fan unit is then flow forced to flow towards the air outlet 14 and pass through the heating element 70. When the air passes through the heating element 70, it will be heated up at the elevated temperature. As a result, the fan heater of the present invention accomplishes the primary function of delivering heated air.

Figure 6:
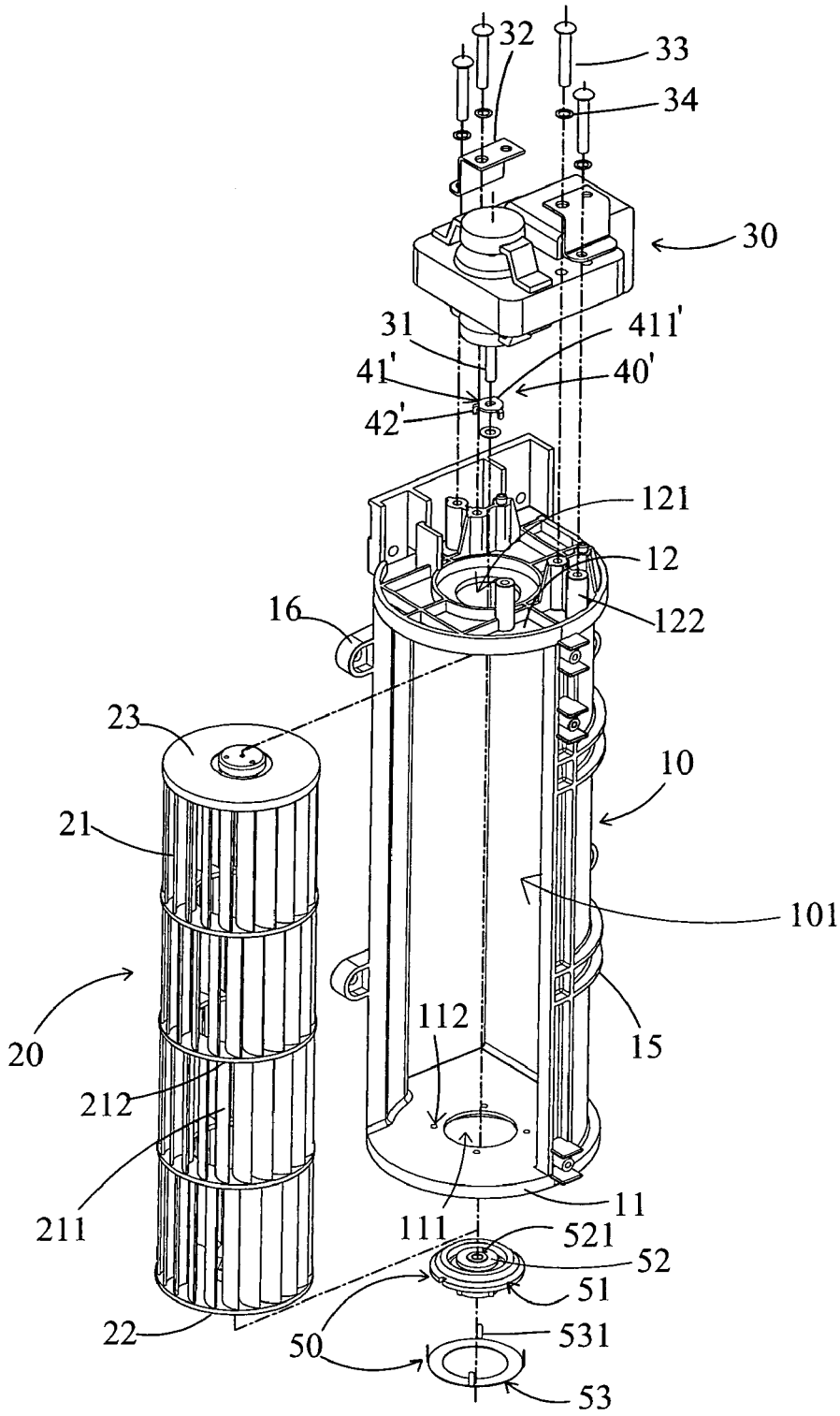
FIG. 6 is an alternative mode of the fan heater according to the above preferred embodiment of the present invention.

Referring to FIG. 6 of the drawings, an alternative mode of the fan heater according to a preferred embodiment of the present invention is illustrated. The alternative mode is similar to the preferred embodiment except the fan connector 40'.

According to the alternative mode, the fan arrangement 20 further comprises a fan connector 40', which is made by plastic materials, mounting the electric unit 30 with the fan unit of the fan arrangement 20 so as to ensure effective power transmission between the electric unit 32 and the fan arrangement 20. More specifically, the fan connector 40' is integrally provided on the bottom mounting member 23 for connecting with the electric unit 30, wherein the fan connector 40' has a main connector body 41', a plurality of connecting legs 42' connected with the bottom mounting member 23, and a connecting hole 411' formed on the connecting body 41', wherein the driving shaft 31 of the electric unit 30 is arranged to connect with the connecting hole 411' of the fan connector 40'. Thus, when the driving shaft 31 is driven to rotate, the bottom mounting member 23 is driven to rotate as well so as to drive the entire fan unit to rotate for generating air flow between the air inlet 13 and the air outlet 14.

It is worth mentioning that a diameter of the connecting hole 411' is slightly smaller than a diameter of the driving shaft 31 so that when the driving shaft 31 is mounted to the connecting hole 43', a lateral movement between the driving shaft 31 and the fan unit can be minimized so as to ensure an effective power transmission between the electric unit 30 and the fan arrangement 20.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A fan arrangement for a fan heater which comprises a heater body having an air inlet, and air outlet, and a receiving cavity to communicate between said air inlet and said air outlet, an electric unit having a driving shaft disposed in said heater body within said receiving cavity for electrically connecting to a power source, and a heating element, wherein said fan arrangement comprises:

a plurality of fan assemblies each of which comprises a plurality of heater fan blades each having a top edge portion and a bottom edge portion, wherein each of said fan assemblies is mounted with said adjacent fan assembly to form an integral fan unit within said receiving cavity, wherein said fan unit is operatively coupled with said electric unit for being driven to rotate by said electric unit, wherein when said electric unit is activated to drive said fan unit to rotate and heat up said heat element at said elevated temperature, said fan assemblies are adapted to draw air flowing from said air inlet to said air outlet via said heating element, so as to heat up said air drawn by said fan unit, and deliver said heated air to a predetermined heating zone from said air outlet;

a top mounting member;

a bottom mounting member, wherein each of said top mounting member and said bottom mounting member has a plurality of the mounting slots indently formed on an inner surface of said respective top mounting member and said bottom mounting member, wherein said mounting slots are aligned with said corresponding heater fan blades of said uppermost and said bottommost fan assemblies respectively so as to mount said corresponding heater fan blades with said top mounting member and said bottom mounting member to form said fan unit having an integral structure; and a plurality of connecting members spacedly supported between said top mounting member and said bottom mounting member, wherein said top edge portion and said bottom edge portion of each of said heater fan blades are mounted with two of said corresponding connecting members, said top mounting member and said bottom mounting member respectively so as to securely attach with said corresponding adjacent fan assembly via said corresponding connecting member, wherein said fan assemblies are spacedly and securely attached on said corresponding connecting members for forming said fan unit of said fan arrangement, wherein each of said connecting members also has a plurality of said mounting slots formed on a top and a bottom sides of said connecting member, wherein each of said heater fan blades are adapted to insert and mount into said corresponding mounting slot for securely attaching thereon, wherein said mounting slots on said top side of said connecting member are not aligned with said mounting slots on said bottom side of said connecting member so as to minimize a thickness of said connecting member and maximize a connection strength between said heater fan blades and said corresponding connecting members.

2. The fan arrangement, as recited in claim 1, further comprising a tubular supporting casing, having a supporting compartment and an air opening communicating said supporting compartment with said heater fan, integrally formed to enclosing said fan unit within said supporting compartment, wherein said tubular supporting casing further comprises a plurality of reinforcing ribs spacedly protruded from an outer surface of said supporting casing so as to enhance an ability to which said supporting casing is capable of resist impact and vibrations.

3. A fan arrangement for a fan heater which comprises a heater body having an air inlet, and air outlet, and a receiving cavity to communicate between said air inlet and said air outlet, an electric unit having a driving shaft disposed in said heater body within said receiving cavity for electrically connecting to a power source, and a heating element, wherein said fan arrangement comprises:

a plurality of fan assemblies, each of comprises a plurality of elongated heater fan blades having a top edge portion and a bottom edge portion, is mounted with said adjacent fan assembly to form an integral fan unit within said receiving cavity, wherein said fan unit is operatively coupled with said electric unit for being driven to rotate by said electric unit, wherein when said electric unit is activated to drive said fan unit to rotate and heat up said heat element at said elevated temperature, said fan assemblies are adapted to draw air flowing from said air inlet to said air outlet via said heating element, so as to heat up said air drawn by said fan unit, and deliver said heated air to a predetermined heating zone from said air outlet;

a top mounting member;

a bottom mounting member, a plurality of connecting members spacedly supported between said top mounting member and said bottom mounting member, wherein said fan assemblies are spacedly and securely attached on said corresponding connecting members for forming said fan unit of said fan arrangement, wherein each of said top edge portion and said bottom edge portion of each of said elongated heater fan blades is mounted with two of said corresponding connecting members, said top mounting member and said bottom mounting member respectively so as to securely attach with said corresponding adjacent fan assembly via said corresponding connecting member; and a tubular supporting casing, having a supporting compartment and an air opening communicating said supporting compartment with said heater fan, integrally formed to enclosing said fan unit within said supporting compartment, wherein said tubular supporting casing further comprises a plurality of reinforcing ribs spacedly protruded from an outer surface of said supporting casing so as to enhance an ability to which said supporting casing is capable of resist impact and vibrations, wherein each of said heater fan blades is made of plastic materials so as to ensure that said weight of said entire fan heater is kept to minimal.

4. The fan arrangement, as recited in claim 2, wherein each of said heater fan blades is made of plastic materials so as to ensure that said weight of said entire fan heater is kept to minimal.

5. A fan arrangement for a fan heater which comprises a heater body having an air inlet, and air outlet, and a receiving cavity to communicate between said air inlet and said air outlet, an electric unit having a driving shaft disposed in said heater body within said receiving cavity for electrically connecting to a power source, and a heating element, wherein said fan arrangement comprises:

a plurality of fan assemblies, each of comprises a plurality of elongated heater fan blades having a top edge portion and a bottom edge portion, is mounted with said adjacent fan assembly to form an integral fan unit within said receiving cavity, wherein said fan unit is operatively coupled with said electric unit for being driven to rotate by said electric unit, wherein when said electric unit is activated to drive said fan unit to rotate and heat up said heat element at said elevated temperature, said fan assemblies are adapted to draw air flowing from said air inlet to said air outlet via said heating element, so as to heat up said air drawn by said fan unit, and deliver said heated air to a predetermined heating zone from said air outlet;

a top mounting member;

a bottom mounting member, a plurality of connecting members spacedly supported between said top mounting member and said bottom mounting member, wherein said fan assemblies are spacedly and securely attached on said corresponding connecting members for forming said fan unit of said fan arrangement, wherein each of said top edge portion and said bottom edge portion of each of said elongated heater fan blades is mounted with two of said corresponding connecting members, said top mounting member and said bottom mounting member respectively so as to securely attach with said corresponding adjacent fan assembly via said corresponding connecting member;

a tubular supporting casing, having a supporting compartment and an air opening communicating said supporting compartment with said heater fan, integrally formed to enclosing said fan unit within said supporting compartment, wherein said tubular supporting casing further comprises a plurality of reinforcing ribs spacedly protruded from an outer surface of said supporting casing so as to enhance an ability to which said supporting casing is capable of resist impact and vibrations; and a fan connector, which is made of plastic materials, mounting said electric unit with said fan unit, wherein said fan connector has a main connector body, a plurality of connecting legs extended from said connector body to connect with said bottom mounting member, and a connecting hole formed on said connecting body for said driving shaft of said electric unit passing therethrough so as to transmit said rotational power of said driving shaft to said fan unit.

6. The fan arrangement, as recited in claim 2, further comprising a fan connector, which is made of plastic materials, mounting said electric unit with said fan unit, wherein said fan connector has a main connector body, a plurality of connecting legs extended from said connector body to integrally connect with said bottom mounting member, and a connecting hole formed on said connecting body for said driving shaft of said electric unit passing therethrough so as to transmit said rotational power of said driving shaft to said fan unit.

7. A fan arrangement for a fan heater which comprises a heater body having an air inlet, and air outlet, and a receiving cavity to communicate between said air inlet and said air outlet, an electric unit having a driving shaft disposed in said heater body within said receiving cavity for electrically connecting to a power source, and a heating element, wherein said fan arrangement comprises:

a plurality of fan assemblies, each of comprises a plurality of elongated heater fan blades having a top edge portion and a bottom edge portion, is mounted with said adjacent fan assembly to form an integral fan unit within said receiving cavity, wherein said fan unit is operatively coupled with said electric unit for being driven to rotate by said electric unit, wherein when said electric unit is activated to drive said fan unit to rotate and heat up said heat element at said elevated temperature, said fan assemblies are adapted to draw air flowing from said air inlet to said air outlet via said heating element, so as to heat up said air drawn by said fan unit, and deliver said heated air to a predetermined heating zone from said air outlet;

a top mounting member;

a bottom mounting member, a plurality of connecting members spacedly supported between said top mounting member and said bottom mounting member, wherein said fan assemblies are spacedly and securely attached on said corresponding connecting members for forming said fan unit of said fan arrangement, wherein each of said top edge portion and said bottom edge portion of each of said elongated heater fan blades is mounted with two of said corresponding connecting members, said top mounting member and said bottom mounting member respectively so as to securely attach with said corresponding adjacent fan assembly via said corresponding connecting member;

a tubular supporting casing, having a supporting compartment and an air opening communicating said supporting compartment with said heater fan, integrally formed to enclosing said fan unit within said supporting compartment, wherein said tubular supporting casing further comprises a plurality of reinforcing ribs spacedly protruded from an outer surface of said supporting casing so as to enhance an ability to which said supporting casing is capable of resist impact and vibrations; and a fan connector, which is made of plastic materials, mounting said electric unit with said fan unit, wherein said fan connector has a main connector body, and a connecting hole formed thereon for securely connecting with said driving shaft of said electric unit, in such a manner that when said driving shaft is driven to rotate, said fan connector transmits said rotational power to rotate said fan unit.

8. The fan arrangement, as recited in claim 2, further comprising a fan connector, which is made of plastic materials, mounting said electric unit with said fan unit, wherein said fan connector has a main connector body, and a connecting hole formed thereon for securely connecting with said driving shaft of said electric unit, in such a manner that when said driving shaft is driven to rotate, said fan connector transmits said rotational power to rotate said fan unit.

9. The fan arrangement, as recited in claim 5, further comprising a bearing unit which comprises a bearing seat supported between a top ceiling of said supporting casing and said top mounting member, a shaft bearing having a through shaft supporting slot integrally mounted on said bearing seat, wherein said top mounting member of said fan arrangement further has a rotating shaft upwardly and integrally extended therefrom to insert into said shaft supporting slot for being rotatably supported by said bearing unit.

10. The fan arrangement, as recited in claim 6, further comprising a bearing unit which comprises a bearing seat supported between a top ceiling of said supporting casing and said top mounting member, a shaft bearing having a through shaft supporting slot integrally mounted on said bearing seat, wherein said top mounting member of said fan arrangement further has a rotating shaft upwardly and integrally extended therefrom to insert into said shaft supporting slot for being rotatably supported by said bearing unit.

11. The fan arrangement, as recited in claim 7, further comprising a bearing unit which comprises a bearing seat supported between a top ceiling of said supporting casing and said top mounting member, a shaft bearing having a through shaft supporting slot integrally mounted on said bearing seat, wherein said top mounting member of said fan arrangement further has a rotating shaft upwardly and integrally extended therefrom to insert into said shaft supporting slot for being rotatably supported by said bearing unit.

12. The fan arrangement, as recited in claim 8, further comprising a bearing unit which comprises a bearing seat supported between a top ceiling of said supporting casing and said top mounting member, a shaft bearing having a through shaft supporting slot integrally mounted on said bearing seat, wherein said top mounting member of said fan arrangement further has a rotating shaft upwardly and integrally extended therefrom to insert into said shaft supporting slot for being rotatably supported by said bearing unit.

13. The fan arrangement, as recited in claim 10, wherein each of said fan blades, having a predetermined blade contour, is spacedly mounted on said connecting members at a predetermined angle in such a manner that when said fan unit is driven to rotate, each of said fan blades is capable of drawing air to pass through said fan unit at a space between each two of said fan blades in a predetermined flow rate and direction, so as to draw air to be heated up by said fan heater.

14. The fan arrangement, as recited in claim 11, wherein each of said fan blades, having a predetermined blade contour, is spacedly mounted on said connecting members at a predetermined angle in such a manner that when said fan unit is driven to rotate, each of said fan blades is capable of drawing air to pass through said fan unit at a space between each two of said fan blades in a predetermined flow rate and direction, so as to draw air to be heated up by said fan heater.

15. The fan arrangement, as recited in claim 12, wherein each of said fan blades, having a predetermined blade contour, is spacedly mounted on said connecting members at a predetermined angle in such a manner that when said fan unit is driven to rotate, each of said fan blades is capable of drawing air to pass through said fan unit at a space between each two of said fan blades in a predetermined flow rate and direction, so as to draw air to be heated up by said fan heater.

* * * * *